United States Patent [19]

Slater

[11] 4,122,954

[45] Oct. 31, 1978

[54] ELEVATED TRAY DISPLAY DEVICE

[75] Inventor: John R. Slater, East Brunswick, N.J.

[73] Assignee: Loew's Theatres, Inc., New York, N.Y.

[21] Appl. No.: 812,159

[22] Filed: Jul. 1, 1977

[51] Int. Cl.[2] ..... A47F 3/14; A47G 1/24; A47F 5/12

[52] U.S. Cl. ..... 211/133; 108/6; 248/457

[58] Field of Search ..... 211/33, 37, 126, 133, 211/150, 168, 170, 173, 174; 248/450, 454, 457, 441, 157, 419, 420; 108/1, 4, 5, 6

[56] References Cited

U.S. PATENT DOCUMENTS

| | | | |
|---|---|---|---|
| 1,228,083 | 5/1917 | Warfel | 248/457 |
| 1,257,586 | 2/1918 | Deming | 248/457 |
| 2,237,914 | 4/1941 | Rader | 108/6 |
| 2,710,051 | 6/1955 | Greenberg | 108/6 |
| 3,392,955 | 7/1968 | Cole | 108/6 X |
| 4,032,014 | 6/1977 | Weiss | 211/49 R |
| 4,036,401 | 7/1977 | Nachtigall, Jr. | 211/133 X |

FOREIGN PATENT DOCUMENTS

| | | | |
|---|---|---|---|
| 666,413 | 9/1938 | Fed. Rep. of Germany | 248/454 |

*Primary Examiner*—Roy D. Frazier
*Assistant Examiner*—Terrell P. Lewis
*Attorney, Agent, or Firm*—Brumbaugh, Graves, Donohue & Raymond

[57] ABSTRACT

An elevated tray display device comprises a base having upper and lower vertical posts joined in telescoping relation for adjustment of the height and rotational orientation of the upper post and a fastener for affixing the upper post at a selected height and selected rotational orientation. A projecting key-type lug near the top of the post is receivable in a selected one of multiplicity of holes in a tray-mounting plate. The holes are spaced apart along the plate and are in different orientations, thus permitting the plate to be mounted and fastened to the upper end of the post in a selected one of a multiplicity of orientations and locations relative to the post. A tray is mounted on the plate for adjustment of its position to a selected one of an infinite number of locations within spaced-apart limit positions along an axis transverse to the post.

7 Claims, 7 Drawing Figures

ELEVATED TRAY DISPLAY DEVICE

BACKGROUND OF THE INVENTION

It has long been common practice in the merchandising of certain products, such as tobacco products, gum and candy, to display the products on or close to the check-out counters. Such a location is desirable because, for one thing, such products are purchased somewhat more frequently than most other products sold in grocery, drug and variety stores, and therefore a location near the cash register is convenient to the customer. Moreover, a location near the cash register is deemed to be of considerable advantage as far as increasing sales because people waiting to check out with other purchases have time to look over the selection of goods and often purchase them on impulse. It is also common practice, because of the high traffic location and the fact that people often have to wait in line to check out of a store, to provide special display racks and trays for promotion of tobacco products, candy and gum. The advantages of special promotional displays at check-out counters have made display space at that location so popular that it is difficult for manufacturers to obtain check-out counter space.

There are, of course, many types and styles of counter-top display cards, racks and trays, many of which are very attractive and effective from the point of view of convenience. Most previously known counter display devices, however, lack versatility in respect of adaptability to a wide variety of locations and orientations on the counter.

SUMMARY OF THE INVENTION

There is provided, in accordance with the present invention, an elevated tray display device which is constructed in a way that permits it to be set up in a number of configurations, thus to permit it to be placed with other displays that are inevitably present at a checkout counter in a manner that will be suited to its environment and will provide high visibility and thus effective promotion. The display device, according to the present invention, comprises a base having lower and upper vertical posts joined in telescoping relation for adjustment of the height and rotational orientation of the upper post, the upper post being affixed at a selected height and orientation by a locking device, such as a set screw. A display tray is mounted on the upper end of the upper post in any selected one of a multiplicity of orientations and locations, relative to the post, by means of a tray-mounting plate. The tray is attached to the plate in a manner that permits the tray to be moved relative to the plate to any of an infinite number of positions between spaced-apart limit positions along an axis transverse to the post. The plate, in turn, is attached to the upper post in a manner that permits it, and therefore the tray that is mounted on it, to be affixed at a selected one of a multiplicity of positions along an axis transverse to the axis along which the position of the tray can be adjusted on the tray-mounting plate. The arrangement by which the mounting plate is attached to the post also permits the tray to be mounted either horizontally or in a tilted position, i.e., a position oblique to the horizontal.

In a preferred embodiment of the invention, a key-type lug is provided adjacent the upper end of the upper post, and a vertically oriented flange on the tray mounting plate has a multiplicity of holes, each of which matches the lug. The holes in the flange are spaced apart and oriented in different positions, thus permitting the position and orientation of the mounting plate to be selected by inserting the lug into a selected one of the holes in the flange. A suitable fastener is provided to affix the mounting plate to the post in the selected position and orientation.

The present invention also includes a special tray that is constructed to receive cigarette packages, the tray being rectangular in plan and having side and end walls, each of which consists of spaced-apart fingers that define openings which permit the packages to be visible. The underside of the tray has a multiplicity of small tabs offset at a closed spacing from the tray bottom and adapted to receive and hold display placards.

For a better understanding of the invention and for a description of other features of the invention, reference may be made to the following description of an exemplary embodiment, taken in conjunction with the figures of the accompanying drawings.

DESCRIPTION OF EXEMPLARY EMBODIMENT

Figure 1:
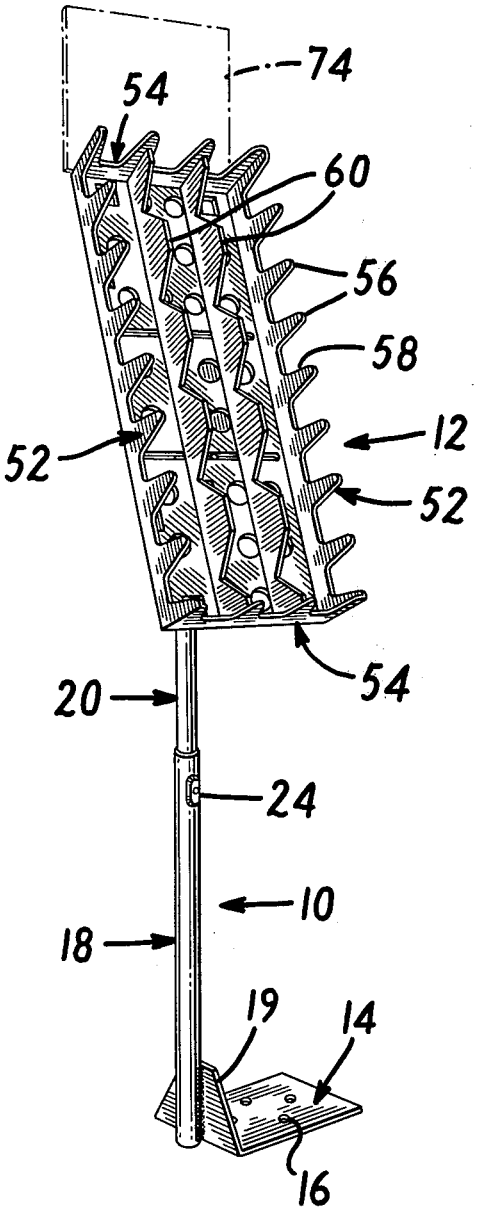
FIG. 1 is a pictorial view of the embodiment showing the tray in a tilted or oblique orientation.

Referring first to FIG. 1, the embodiment of the invention shown in the drawings consists of a base 10 constructed to be fastened or otherwise suitably supported on a counter and a tray 12 mounted on the base 10 in a manner that permits it to be adjusted as to height, position, both vertical and lateral, and orientation with respect to the vertical, the display device as shown in FIG. 1 being set up with the tray in a tilted position relatively high above the bottom of the base.

Figure 5:
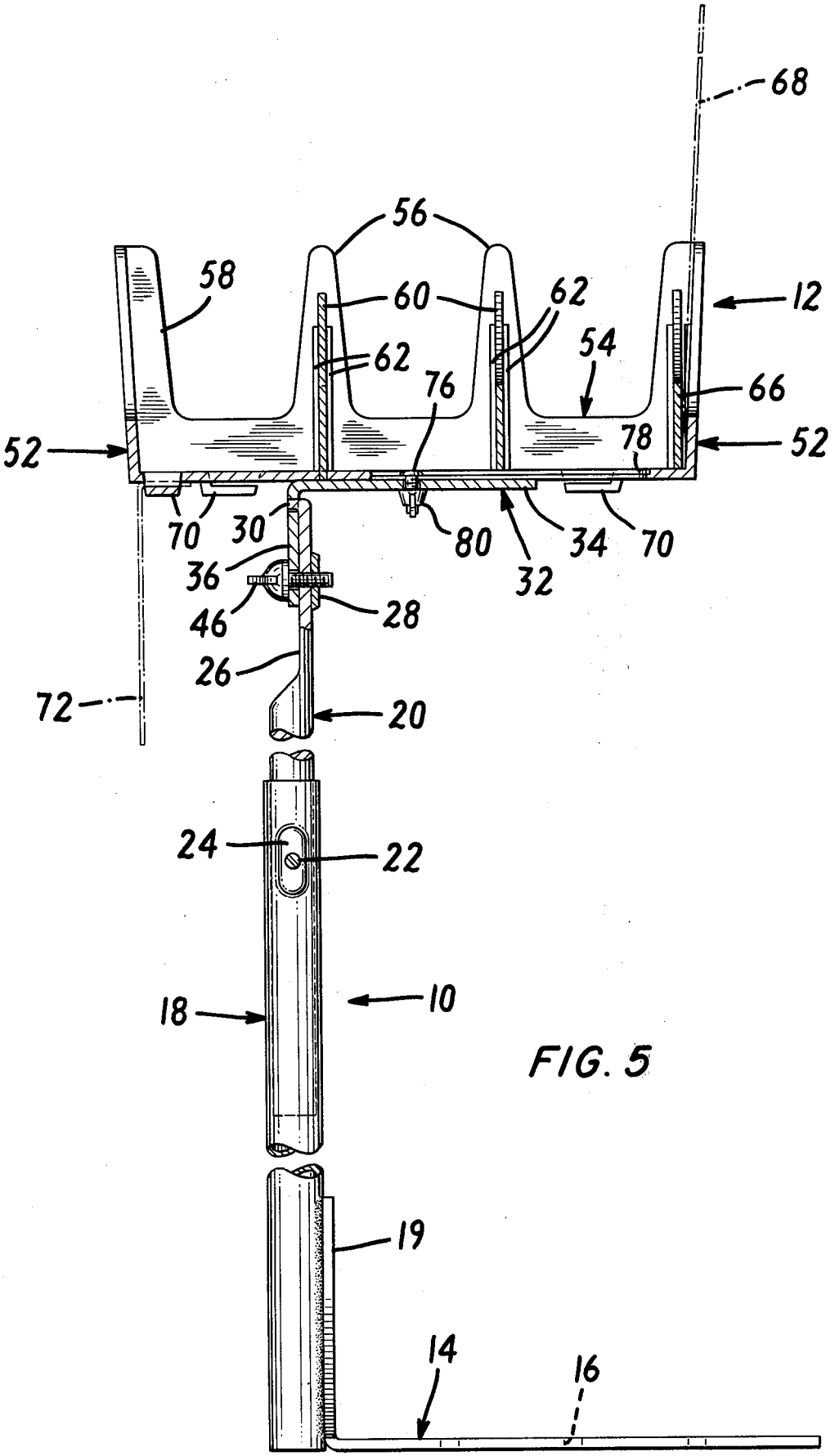
FIG. 5 is an end cross-sectional view of the embodiment taken along a broken plane represented by the lines 5—5 of FIG. 3.
Figure 6:
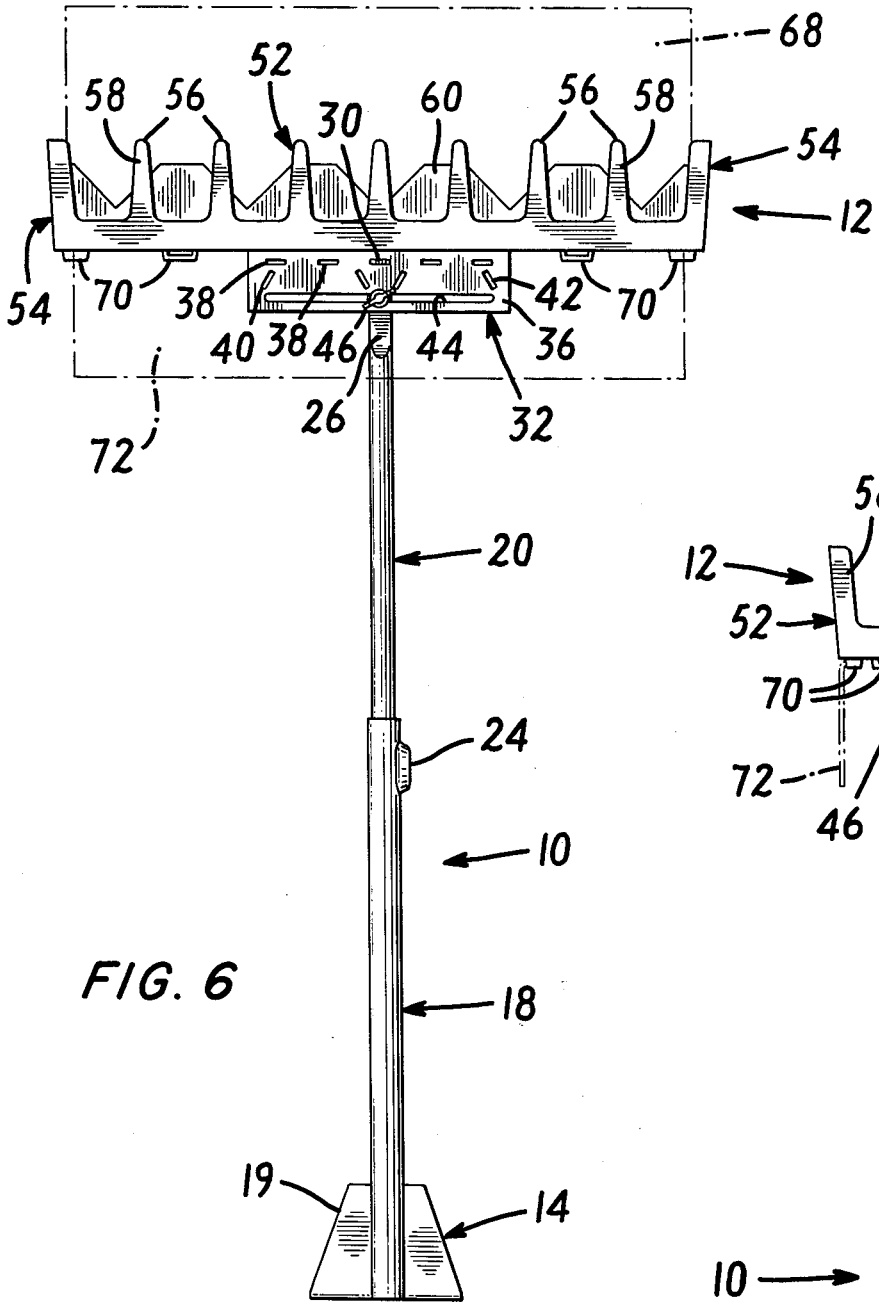
FIG. 6 is a side elevational view of the display device showing the tray in a horizontal position.
Figure 7:
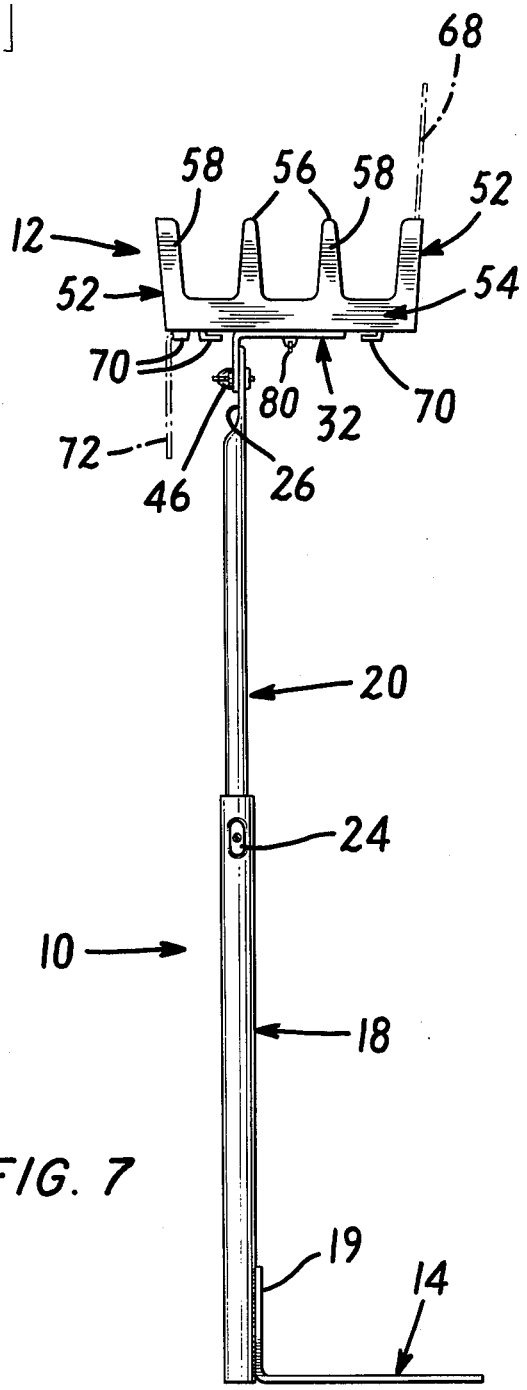
FIG. 7 is an end elevational view of the embodiment, again with the tray in a horizontal position.

Referring to FIG. 5, which shows the base 10 on a relatively large scale, the base includes an "L"-shaped foot 14 which is provided with holes 16 that permit it to be fastened by screws to a counter top or other supporting surface, a lower post 18 which is fastened, such as by welding, to a vertically tapered flange 19 on the foot 14, and an upper post 20. The lower post 18 is tubular and receives the upper post 20 telescopically. A set screw 22 is threaded through a small fitting 24 welded near the top of the lower post 18 and upon being tightened secures the upper post at a desired height and rotational orientation relative to the lower post. The embodiment of the invention shown in the drawings is particularly well suited for use with a cash register, in which case the horizontal part of the foot 14 is pushed under the bottom of the register and the weight of the register holds the display device securely in position.

Figures 3, 4:
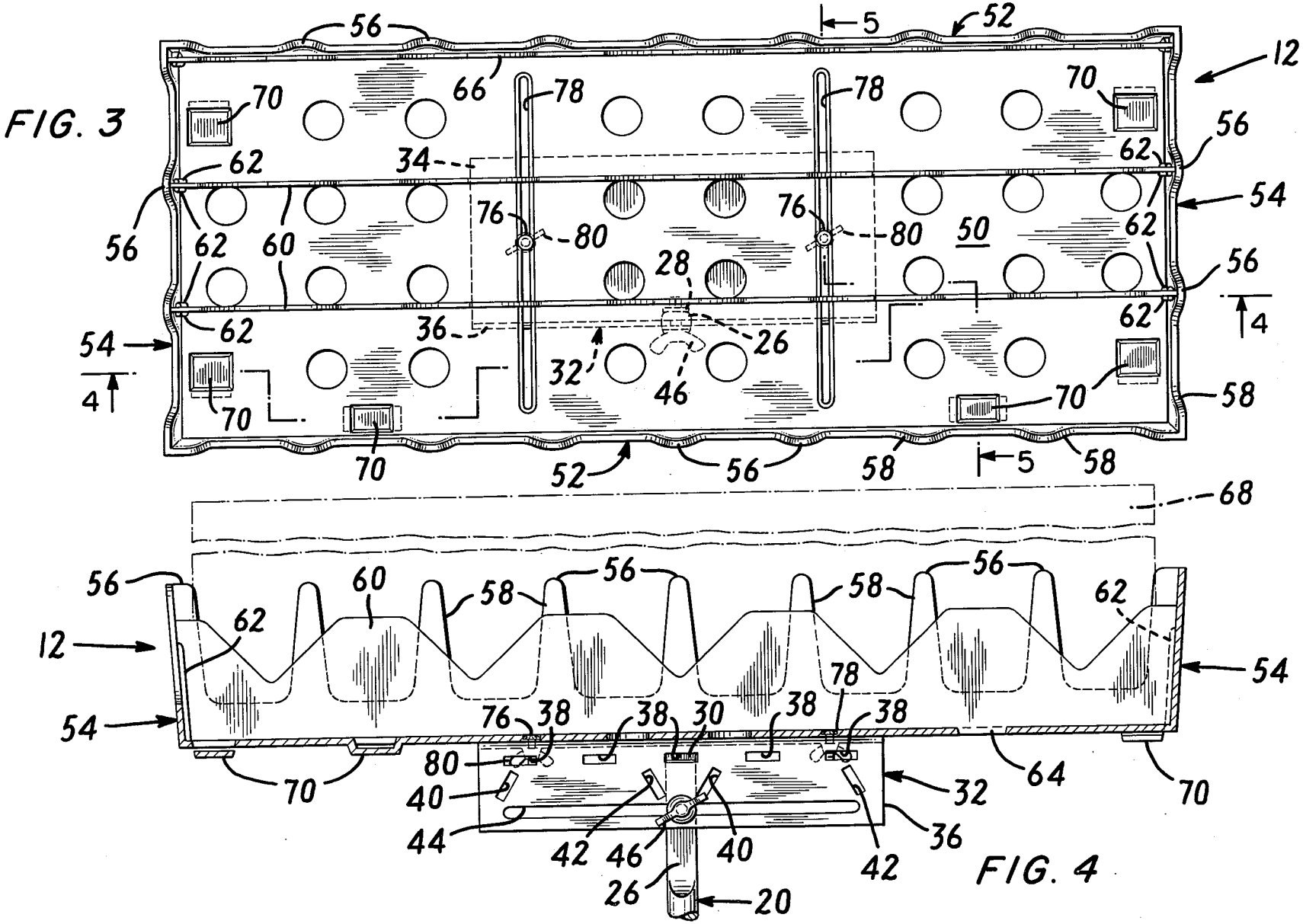
FIG. 3 is a top view showing the tray positioned horizontally on the post.
FIG. 4 is a cross-sectional view of the upper part of the display device taken generally along a broken plane indicated by the lines 4—4 in FIG. 3 and in the direction of the arrows.

The upper end of the upper post 20 is machined ground or otherwise worked upon to provide a flat surface 26, and a small threaded plate 28 is welded to the wall of the upper post 20 on the surface opposite from the flat surface 26. A small key-type lug 30, which may be formed integrally with the post or may be a small component welded to the post, projects from the flat surface 26. In the embodiment shown in the drawings (see, for example, FIG. 4) the lug 30 is rectangular and is located at the extreme upper end of the post 20, but it will be apparent to those skilled in the art that the shape and location of the lug 30 are not critical.

The tray 12 is attached to the upper post 20 of the base 10 by a tray-mounting plate 32 of generally "L" shape in end cross section and consisting, therefore, of a web portion 34 and a flange portion 36. As may best be observed in FIG. 4, the flange portion 36 of the plate 32 has several rectangular holes or slots, each of which matches in size and shape the small lug 30 at the upper end of the post 20. One set of slots 38 is located in a row adjacent the upper edge of the flange 36, each such slot 38 being oriented with the longer dimension horizontal. There are two pairs of slots 40 and 42 oriented oblique to the vertical in spaced relation, the two slots 42 being of an opposite hand from the slots 40. A long narrow slot 44 near the bottom edge of the flange 36 extends over most of the length of the flange and allows the threaded shank of a thumb screw 46 to pass through the flange and into the threaded plate 28 at the upper end of the upper post 20.

Figure 2:
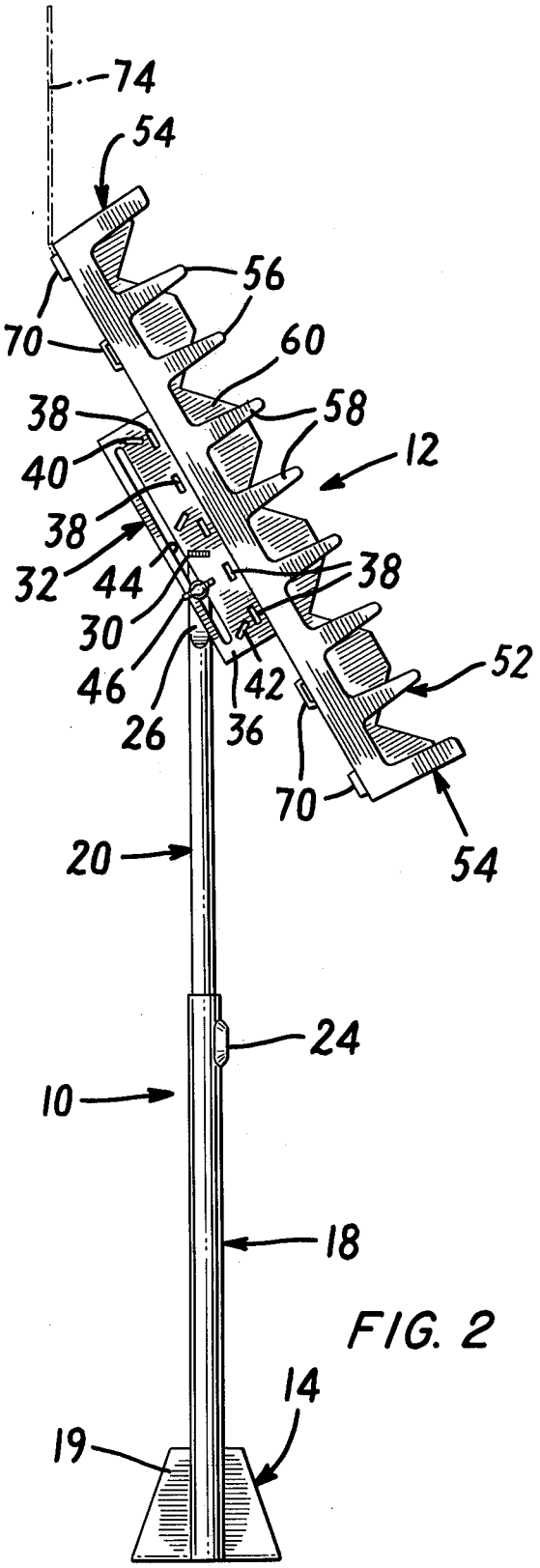
FIG. 2 is a side elevational view of the embodiment.

From an examination of the several figures of the drawings, it should be apparent that the tray-mounting plate 32 can be fastened to the post in various positions and orientations relative to the post. For example, in FIG. 4, the plate is fastened to position the web portion (and therefore the tray) horizontally and in a centered position on the post in the plane of the web portion 36, the lug 30 on the upper post being received in the center, horizontally-oriented slot 38 in the flange. The lug 30 extends out into the hole 38, and the key action of the rectangular lug in a matching hole assures maintenance of that orientation. The flange 36 of the plate 32 is clamped to the flat surface 26 of the post 20 by tightening the thumb screw 46. By loosening the thumb screw, the plate can be repositioned and reoriented to locate the lug 30 in any of the slots 38, 40 or 42. For example, in FIG. 2, the plate and tray are shown in a tilted position with the lug 30 received in one of the slots 40 that is oblique to the axis of the slot 44. It will be observed that the shifting of the plate to move the lug from one slot to another involves movement of the tray relative to the post along the axis of the slot 44; as described below, the tray is mounted on the plate 32 to be adjusted along an axis that is perpendicular to the axis 44. The ability to change the position of the tray along mutually perpendicular axes relative to the post is an important advantage of the display device.

The tray 12 has a rectangular bottom 50 (see FIG. 3), side walls 52, and end walls 54. The walls 52 and 54 are constituted in major part by upwardly extending fingers 56 which define generally "U"-shaped openings 58. The spacing of the fingers 56 and the size and shape of the openings 58 between them are, in the embodiment, shaped so that the labelling of cigarette packs received in the tray are prominently visible. It will be apparent that the configuration of the tray may vary considerably so that the tray is suitable for the goods with which the display device is used. The tray shown in the drawings is best made by molding from plastic, but again, the material and method of manufacture are matters of choice. The tray 12 of the embodiment includes a pair of divider walls 60 extending the longer direction and spaced to provide receptacles for rows of cigarette packs standing upright with their side walls parallel to the end walls 54 of the tray. The dividers 60 slide into a space between small ribs 62 on the end walls and tabs 64 along the bottom of each divider are received in slots formed in the bottom 50 of the tray.

A third separator 66 is mounted in the same manner as the divider walls 60 closely adjacent one side wall 52 of the tray and defines a narrow space for reception of the lower end of a display placard 68 (see FIG. 5). Several tabs 70 molded into the bottom 50 of the tray and located closely adjacent the underside of the tray receive and hold promotional placards 72 (see FIG. 5) in a position extending down from either side of the tray and placards 74 extending up or down from the ends of the tray (see FIG. 2).

The tray 12 is fastened to the mounting plate 32 by a pair of screws 76, each of which passes through the slot 78 molded into the tray bottom 50 and threaded into wing nut 80 that bears against the underside of the web portion 34 of the mounting plate 32. The slots 78 are parallel, and by loosening the wing nuts 80, the tray 12 can be slided along an axis parallel to the axes of the slot 78, thus to change the position of the tray relative to the post along an axis perpendicular to the axis along which the plate 32 is adjustable relative to the post 20.

Thus there is provided, in accordance with the invention, a display device in which a tray is mounted on a base for (1) adjustment of its height above a supporting surface, (2) adjustment of its rotational orientation relative to the base, (3) adjustment of its angular orientation relative to a given plane, e.g., the vertical, and (4) adjustment of its position along two mutually perpendicular axes. Thus, the tray can be set up in a position which will best fit into an environment which will normally involve other promotional display cards, racks and trays in a manner best suited for visibility from a merchandising point of view. Moreover, the display device can be used in conjunction with cash registers of various types placed on counters in various positions. The display device also makes provision for a variety of locations of promotional placards.

I claim:

1. An elevated tray display device comprising a base having a lower vertical post and an upper vertical post, the upper post being received in telescoping relation on the lower post for adjustment of the height and rotational orientation of the upper post relative to the lower post, and having means for affixing the upper post to the lower post at a selected height and selected rotational orientation; a tray-mounting plate; means for attaching the plate to the top of the post in a selected one of a multiplicity of orientations and locations relative to the post including a projecting key-type lug on the post, a multiplicity of slots, each of which matches the lug, on the plate, and releasable fastener means for affixing the plate to the post with a selected slot on the plate receiving the lug; a tray adapted to receive products for dislay; and means mounting the tray on the plate in a selected one of an infinite number of locations within spaced-apart limit positions along at least one axis transverse to the vertical.

2. A display device according to claim 1, wherein the plate includes a planar top portion and a flange perpendicular to the top portion and dependent therefrom, and the slots are located in the flange.

3. A display device according to claim 2, wherein the slots are oriented and positioned on the flange relative to the top portion such that the top portion is positionable on the base in at least two positions in a horizontal orientation and in at least two positions in an orientation oblique to the horizontal.

4. A display device according to claim 1, wherein the tray is rectangular in plan and includes side and end walls having spaced-apart fingers defining openings such that the packaging of products received is visible through the openings.

5. A display device according to claim 1, wherein the bottom of the tray includes on the underside a multiplicity of tabs offset at a close spacing from the tray bottom and adapted to receive and hold display placards.

6. A display device according to claim 1 and further comprising a partition wall located in close proximity to a side wall of the tray and defining therewith a slot for receiving and holding a display placard.

7. A display device according to claim 1, wherein the means mounting the tray on the plate includes spaced-apart holes in the plate, a pair of parallel slots in the bottom of the tray spaced-apart a distance equal to the spacing between the holes in the plate and releasable fasteners passing through each hole and a corresponding slot.

* * * * *